United States Patent [19]

Pilch

[11] Patent Number: 4,904,149

[45] Date of Patent: Feb. 27, 1990

[54] SWING MECHANISM FOR AN EARTH-MOVING APPARATUS

[75] Inventor: John S. Pilch, Ware, Mass.

[73] Assignee: Ware Machine Works, Inc., Ware, Mass.

[21] Appl. No.: 234,306

[22] Filed: Aug. 19, 1988

[51] Int. Cl.[4] ..... B66F 9/14

[52] U.S. Cl. ..... 414/695.6; 414/695.5

[58] Field of Search ..... 414/686, 687, 694, 695, 414/695.5, 695.6

[56] References Cited

U.S. PATENT DOCUMENTS 3,891,104 6/1975 Pilch ..... 414/695

FOREIGN PATENT DOCUMENTS 224765 2/1959 Australia ..... 414/695.6

*Primary Examiner*—Robert J. Spar
*Assistant Examiner*—Donald W. Underwood
*Attorney, Agent, or Firm*—Norman S. Blodgett; Gerry A. Blodgett

[57] ABSTRACT

A swing mechanism for an earth-moving apparatus having a main frame and a swing frame which is pivoted at the main frame about a vertical axis. The swing mechanism includes a pair of slide members which are in sliding engagement with a pair of slide surfaces. Each slide member is operatively connected to the swing frame by means of a flexible connector such as a chain. One end of each chain is connected to each slide member and the opposite end of the chain is connected to the swing frame. Each slide member is driven along the slide surface by means of a fluid actuator. One end of the fluid actuator is connected to the slide member, the opposite end of the fluid actuator is connected to the main frame. The slide surfaces extend outwardly from a front to back midplane of the main frame in opposite directions. Outward movement of one of the slide members along its respective slide surface by its respective fluid actuator causes the swing mechanism to move the boom toward one side of the main frame and movement of the other slide member outwardly along its respective slide surface by its respective fluid actuator causes the swing mechanism to move the boom to the opposite side of the main frame.

13 Claims, 7 Drawing Sheets

10
12
14
15
17
20
21
22
24
26
28
30
31
32
33
34
40
44
48
49
50
52
54
56
58
59
60
61
62
64
66
68
49'
50'
52'
54'
59'
60'
61'
62'

SWING MECHANISM FOR AN EARTH-MOVING APPARATUS

BACKGROUND OF THE INVENTION

This invention relates to a swing mechanism for the boom of an earth-moving apparatus such as a backhoe which includes an implement such as a bucket or other tool associated with the remote end of the dipper.

The swing mechanism includes a main frame which is attached to a fixed mount or to a vehicle such as a tractor. The bucket or other implement to be manipulated is connected to a dipper which is carried on the boom which, in turn, is carried on a swing frame. The swing frame is pivotally connected to the main frame for swinging about a vertical axis from one side of the main frame to the opposite side through an angle of approximately 200° or more. The swing frame is conventionally powered by hydraulic actuating means acting through flexible means such as chains or cables. Some of the earlier swing mechanisms are powered by two ram type hydraulic actuators. One end of a flexible means such as a chain is attached to one end of the hydraulic actuator and the other end of the chain is attached to the swing frame. Another chain is attached to the other hydraulic actuator and the other end of the chain is also attached to the swing frame. One of the hydraulic actuators causes one of the chains to rotate the swing frame in one direction while the other hydraulic actuator retains the tautness of the chain in the other direction and vice versa.

Later improvements in the actuating means for the swing mechanism included replacing the two hydraulic actuators with a single double-acting hydraulic actuator. The driving connection between the hydraulic actuator and the swing frame includes a pair of elongated flexible connectors such as chains or cables. One end of each of the connectors is attached to the swing frame. The other end of each connector is attached to the portion of the hydraulic actuator which has a cylindrical bore. Rectilinear movement of the portion of the hydraulic actuator which has the cylindrical bore causes the swing frame to swing about a vertical pivot means. Such a device is shown in my U.S. Pat. No. 3,891,104.

Another similar swing mechanism for a boom is shown in U.S. Pat. No. 4,003,484 to Jones et al. The drive in this patent also includes a single hydraulic actuator and an elongated flexible connecting means such as a chain. The cylinder portion of the hydraulic actuator is pivotally attached at one end to the main frame. The piston portion of the hydraulic actuator is pivotally connected to a bar for lateral movement relative to the front to back axis of the main frame. A shaft on the swing mechanism is journalled onto the frame and carries a pair of superimposed sprocket wheels that are partially wrapped in opposite directions by a pair of drive chains. The chains are anchored to opposite ends of a bar which is reciprocable transversely of the upright axis of the pivot shaft. The bar is coupled to the piston portion of the hydraulic actuator so that when the hydraulic actuator is actuated, the bar reciprocates to wrap one of the chains about its sprocket wheel while the other chain is unwrapped from its sprocket wheel for swinging the boom about its vertical axis. My U.S. Pat. No. 4,078,680 discloses a swing mechanism whereby the flexible connector or chain is connected at one end to a drum which is fixed to the boom and at its other end to one end of a lever. The opposite end of the lever is pivoted to the main frame. The piston portion of the hydraulic actuator is pivotally attached to an intermediate portion of the pivoted lever. The cylindrical portion of the hydraulic actuator is pivotally connected to the main frame. The chain, pivoted lever and hydraulic actuator are utilized to swing the boom to one side of the tractor. A chain, pivoted lever and hydraulic actuator is utilized to swing the boom to the opposite side of the tractor.

One of the major disadvantages which is inherent in prior art swing mechanisms which utilize a flexible connector such as a chain is that the mechanism begins to lose its precision of movement as the chain begins to wear. The chains wear due to the hard and continuous use through which these machines are subjected to, the operator finds it increasingly difficult to locate the earth-moving member at a desired location. When the problem becomes acute enough, the chains must be manually adjusted. Proper tensioning is difficult to achieve. If the chains are over- tensioned, they are prone to break. If they are under- tensioned, the boom is hard to control because of looseness. Manually adjusting the tension of the chains is time-consuming, costly and impractical.

It is, therefore, a principal object of the invention to provide a hydraulically actuated swing mechanism for earth moving apparatus which includes a flexible connector, such as a chain and slide member, interposed between the swing frame and the actuator in which the mechanism automatically compensates for wear or stretching of the flexible connector.

Another object of the invention is to provide a swing mechanism as described above in which the flexible connector is a chain for which no sprockets are utilized.

A further object of the present invention is the provision of a swing mechanism for an earth moving apparatus in which each drive cylinder positively maintains a firm engagement between a slide member and guide means so that slop and play is eliminated thereby providing for a smoother acting mechanism and enabling the operator to have better control of the swing movement.

A still further object of the invention is the provision of a swing mechanism for an earth moving apparatus in which the guide means provides protection for the extended portions of the chain, to prevent digging debris from being packed into the chains which debris causes stretching, wear and failure of the chains.

With these and other objects in view, as will be apparent to those skilled in the art, the invention resides in the combination of parts set forth in the specification and covered by the claims appended hereto.

SUMMARY OF THE INVENTION

In general, the invention consists of a swing mechanism for an earth moving apparatus, a main frame and a swing frame for swinging relative to the main frame about a vertical axis. A swing mechanism of the present invention comprises a pair of laterally extending guide surfaces which extend in opposite directions from the center of the earth-moving apparatus. A pair of slide members are in sliding engagement with the respective pair of guide surfaces. Each slide member is pivotally connected to one end of a hydraulic actuator, the other end of the hydraulic actuator being pivotally connected to the main frame. One end of an elongated drive connector is attached to each slide member. The other end of the elongated drive connector is operatively connected to a drum which forms part of the swing frame. Actuation of one of the fluid actuators causes its respective slide member to slide along its respective slide surface toward one side of the earth moving apparatus and thereby moving the boom in one direction. Actuation of the other fluid actuator causes its respective slide member to slide along its respective slide surface towards the opposite side of the earth-moving apparatus for moving the boom in the opposite direction.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

Figure 2:
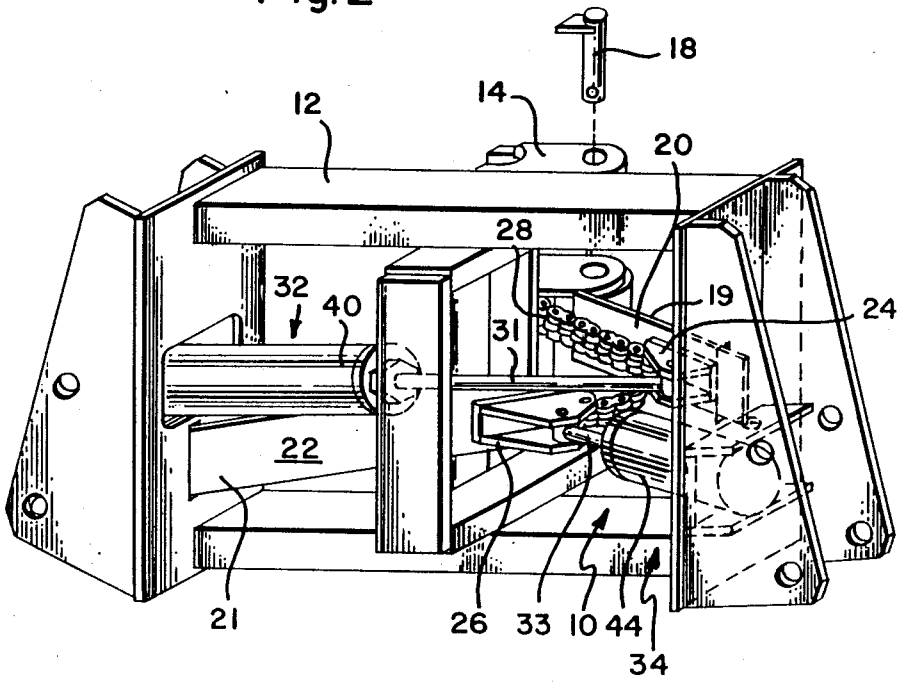
FIG. 2 is a perspective view of the swing mechanism viewed from the rear of the main frame of the backhoe.
Figure 1:
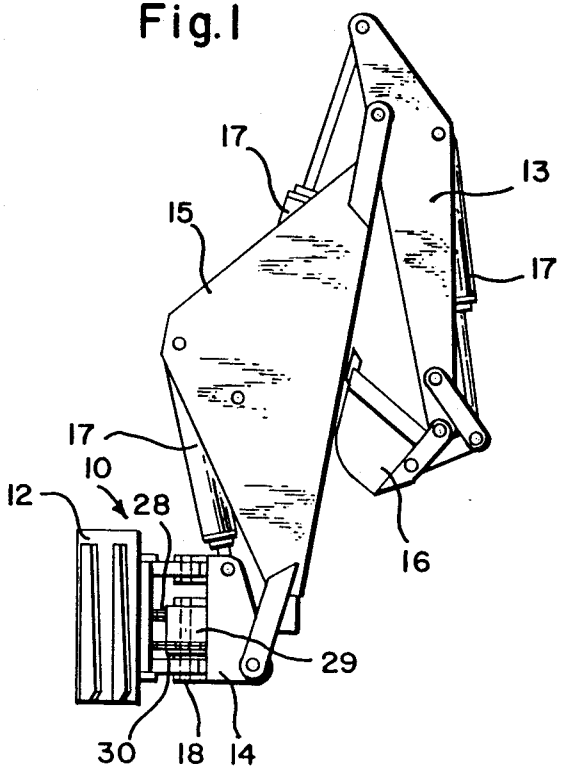
FIG. 1 is a side elevational view of a backhoe utilizing the swing mechanism embodying the present invention.

Referring first to FIGS. 1,2,3, 6 & 7 which best show the general features of the invention, the swing mechanism of the present invention is generally indicated by the reference numeral 10, and is shown applied to a main frame 12. A swing frame 14 is pivotally mounted on the main frame 12 by means Of a pivot pin 18 for swinging movement about a vertical axis from one side of the main frame to the opposite side of the main frame. The swing frame 14 supports a boom 15 which, in turn, supports a dipper 13 which, in turn, supports a bucket 16. The swing frame 14 also supports fluid actuators 17 for manipulating the boom, the dipper 13 and bucket 16 for movement within vertical planes.

Figures 3, 4, 5:
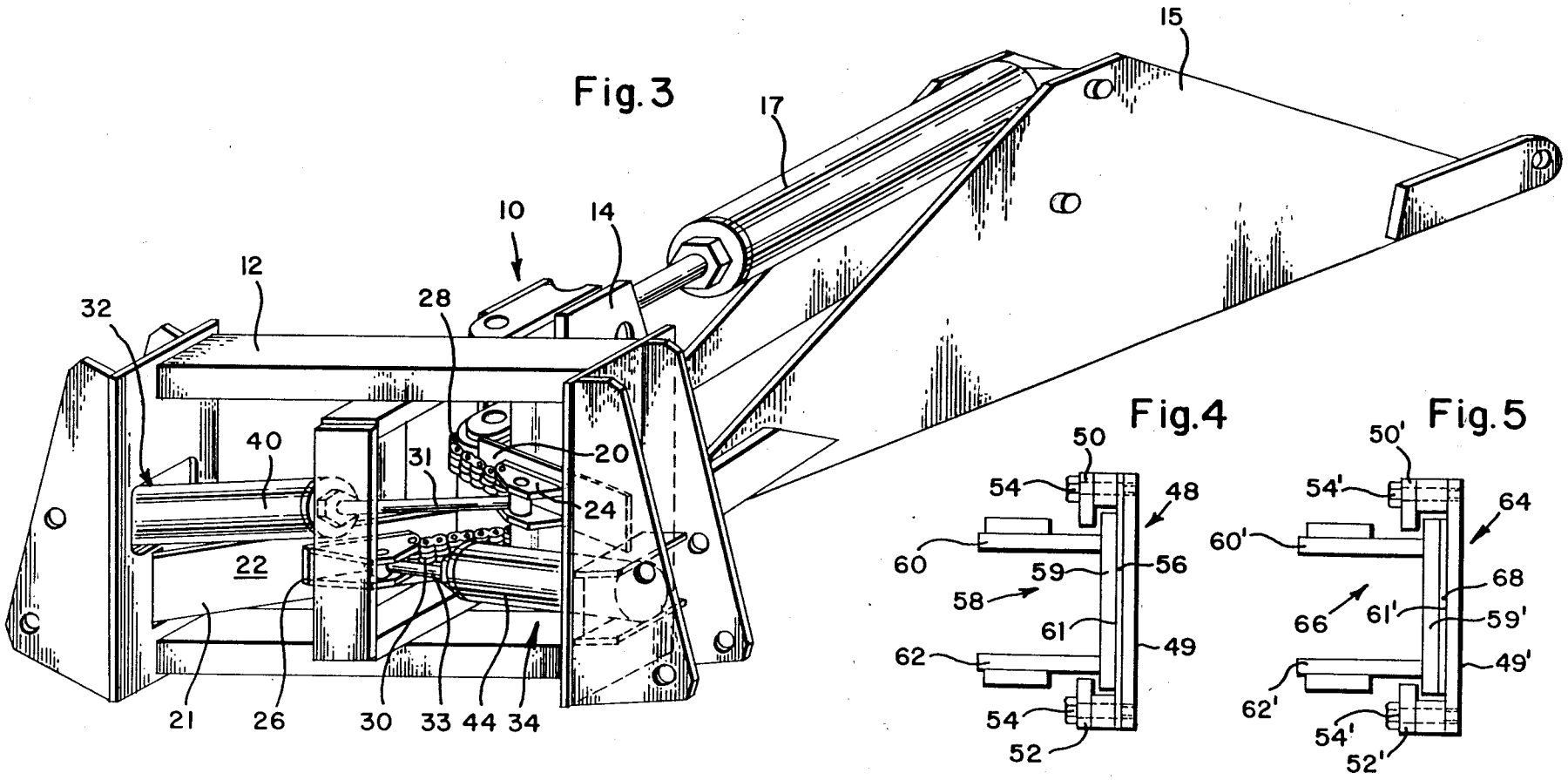
FIG. 3 is a perspective view similar to FIG. 2 and also showing the boom.
FIG. 4 is a fragmentary end view of a modified guide member which forms part of the swing mechanism of the present invention.
FIG. 5 is a view similar to FIG. 4 showing a still further modified guide mechanism.
Figure 6:
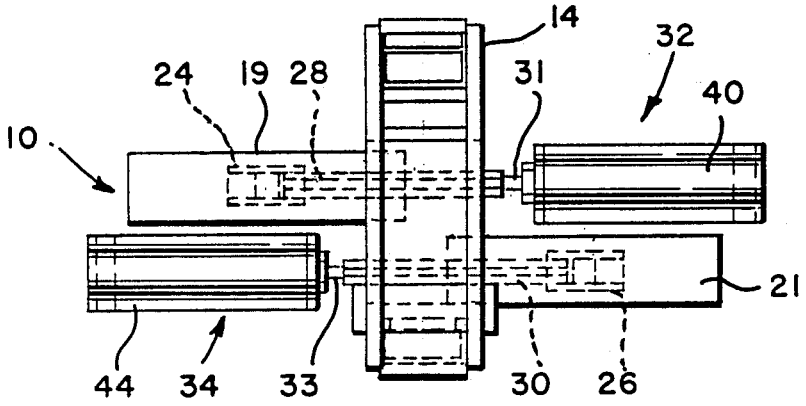
FIG. 6 is a fragmentary front elevational view of the swing mechanism.
Figure 7:
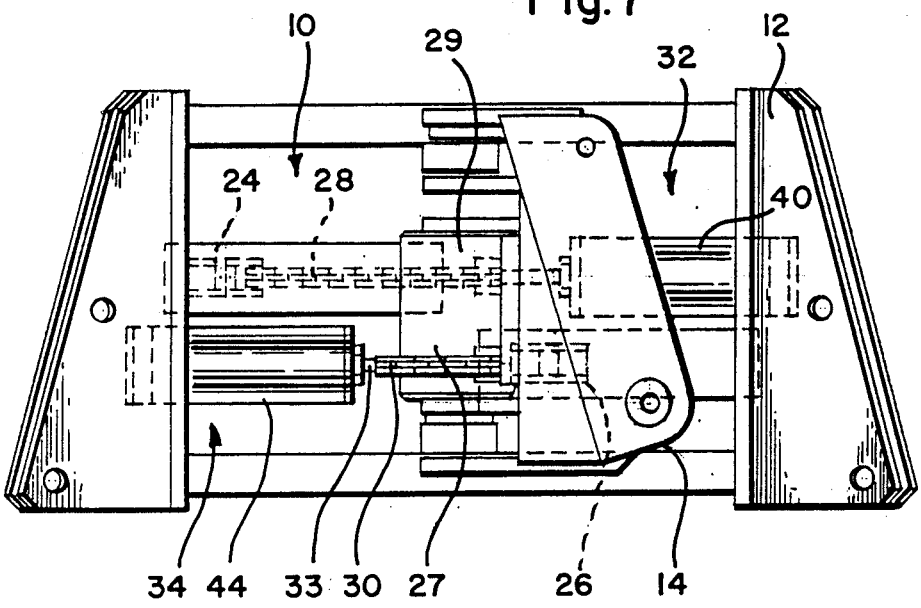
FIG. 7 is a view similar to FIG. 6, showing the swing mechanism fixed to the main frame.

The swing mechanism 10 comprises a first guide which is in the form of a plate 19 having a first continuous slide surface 20. A second guide which is in the form of a plate 21 having a second continuous slide surface 22. The plates 19 and 21 are fixed to the main frame 12 so that the surfaces 20 and 22 face rearwardly. The plate 19 is located above the plate 21 as shown in FIGS. 2 and 3. A first slide member 24 is in sliding contact with the first slide surface 20. A second slide member 26 is in sliding contact with the second slide surface 22.

Figure 8:
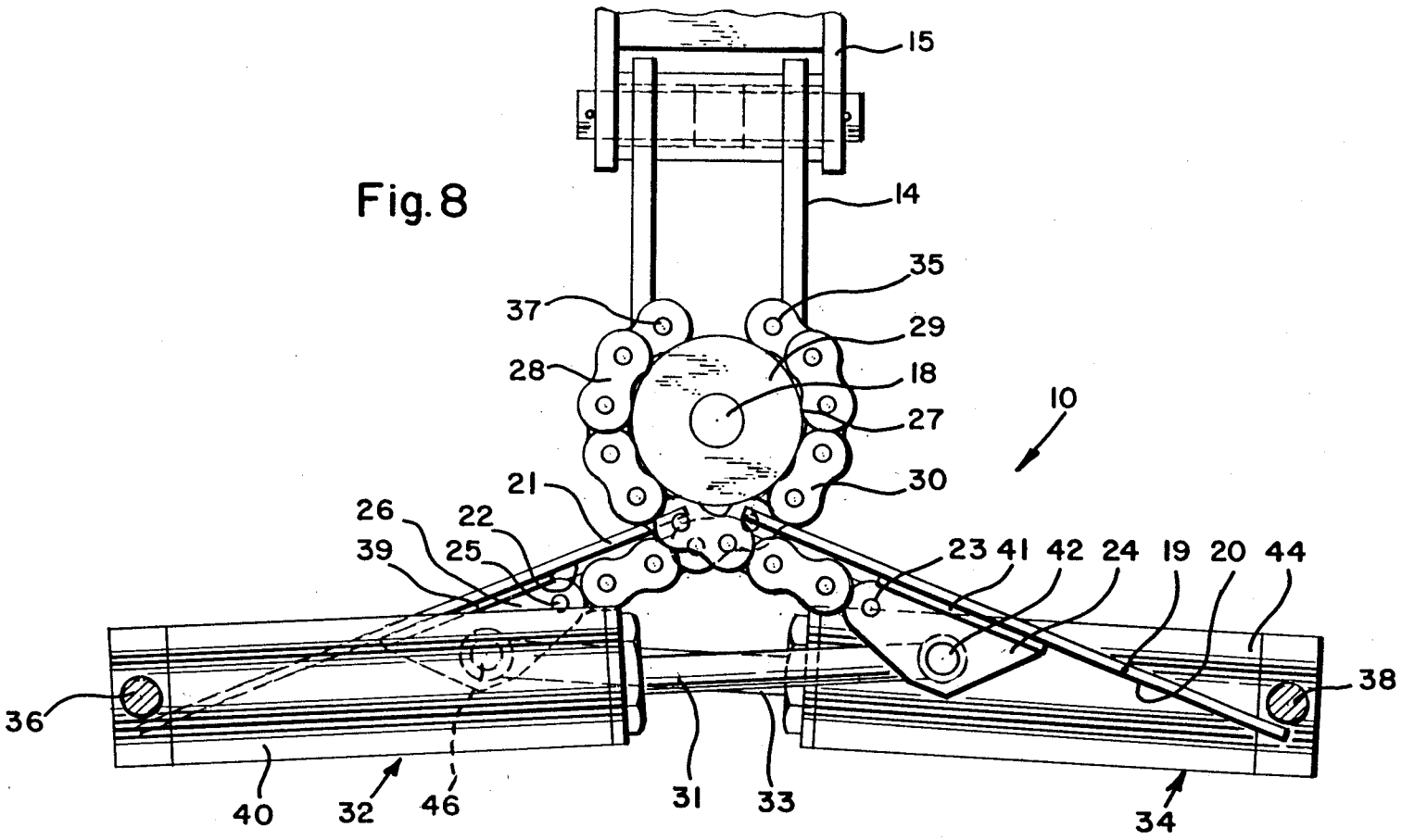
FIG. 8 is a fragmentary plan view of the swing mechanism, showing the swing frame and boom in the mid position.
Figure 9:
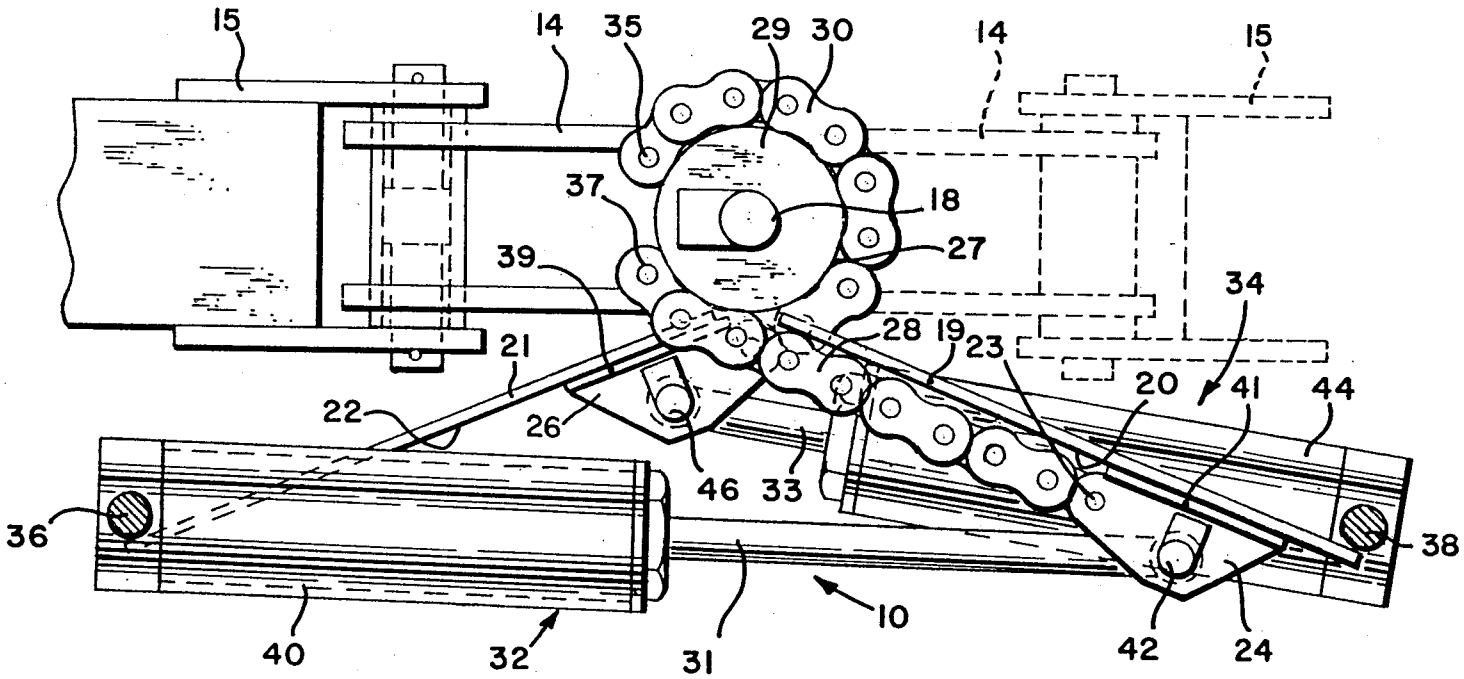
FIG. 9 is a view similar to FIG. 8 showing the swing frame and boom in the extreme left hand position from the operator's point of view.

Referring also to FIGS. 8 and 9, a first elongated drive connector, in the form of a chain 28, is connected at one end by means of a pin 23 to the slide member 24. The other end of the chain 28 is connected to the swing frame 14 by means of a pin 37. The chain 28 extends from the pin 37 around a drum 29 which forms part of the swing frame 14 to the pin 23. The chain 28 is in contact with the curved outer surface 27 of the drum 29. Preferably, the surface 27 is concentric about the axis of the pivot pin 18. A second elongated drive connector, in the form of a chain 30 is connected at one end by means of a pin 25 to the slide member 26. The other end of the chain 30 is connected to the swing frame 14 by means of a pin 35. The chain 30 extends around the drum 29 in contact with the surface 27 from the pin 35 to the pin 25.

A first fluid actuator, generally indicated by the reference numeral 32, is drivingly connected to the first slide member 24 for moving the slide member along the first guide surface 20. A second fluid actuator, generally indicated by the reference numeral 34, is drivingly connected to the second slide member 26 for moving the slide member along the second guide surface 22. The first fluid actuator 32 comprises a cylinder 40 which contains a piston (not shown) and a piston rod 31. The cylinder 40 is pivotally connected by means of a pivot pin 36 to the main frame 12. The piston rod 31 is pivotally connected to the first slide member 24 by means of a pivot pin 42. The second fluid actuator 34 comprises a cylinder 44 which contains a piston (not shown) and a piston rod 33. The cylinder 44 is pivotally connected by means of a pin 38 to the main frame 12. The piston rod 33 is pivotally connected to the second slide member 26 by means of a pivot pin 46.

The piston of each fluid actuator is secured to its respective piston rod. Oil or other fluid under pressure is supplied through hoses (not shown) from a hydraulic pump (not shown) and directed by a control valve (not shown). Hydraulic fluid under pressure acts against the piston to extend the piston rod outwardly of the cylinder. This constitutes a positive power stroke of the fluid actuator.

Referring particularly to FIG. 8, the swing frame 14 which carries the boom 15 is shown in its mid position so that the boom extends forwardly and directly in front of the main frame. In this position, the piston rods 31 and 33 of the first and second fluid hydraulic actuators 32 and 34, respectively, are partially extended from their respective cylinders 40 and 44, respectively. Referring particularly to FIG. 9, the swing frame 14 is shown in its extreme left hand position from the operator's point of view so that the boom extends to the left of the main frame. In this position, the piston rod 31 is further extended from its cylinder 40 and the piston rod 33 is further retracted within its cylinder 44. The chain 28 is essentially unwrapped from the surface 27 of the drum 29 and the chain 30 is nearly completely wrapped about the surface 27. The swing frame 14 is moved from the left hand position shown in FIG. 9 to its extreme right hand position, shown in dotted lines in FIG. 9, by activating the hydraulic actuator 34 and, simultaneously, deactivating the hydraulic actuator 32. Upon activation of the hydraulic actuator 34, the power chamber of the cylinder 44 is filled with hydraulic fluid to drive the piston within the cylinder 44 from right to left as viewed in FIG. 9, thereby extending the piston rod 33 from right to left. This action forces the second slide member 26 along the guide surface 22. This action unwraps the chain 30 from the drum 29 and causes the swing frame 14 to rotate clockwise, as viewed in FIG. 9, from the left hand position (shown in full lines) to the right hand position (shown in dotted lines) As the slide member 26 moves along the slide surface 22 from right to left as viewed in FIG. 9, the cylinder 44 pivots in a counter-clockwise direction about the pivot pin 38 to compensate for the rearward component of the movement of the slide member 26, due to the angle of the slide surface 22. The movement of the swing frame 14 in either direction comes as a result of a positive power stroke of one of the hydraulic actuators. For each unit of hydraulic fluid which is forced into one of the cylinders in a power stroke, an equal unit of hydraulic fluid is forced out of the other cylinder by the reverse action of its respective slide member on its respective piston rod as its respective chain is wrapped around the drum 29 by the motion of the swing frame. Therefore, the swing frame 14 always moves under positive hydraulic pressure and all the connecting elements are under positive tension. This enables the operator to control the movement of the boom with a high degree of precision. This positive tension is maintained indefinitely, even as the chain wears, due to the free sliding relationship between each of the slide members and their respective slide surfaces. As the chain wears, it lengthens. This causes the slide member to be pushed slightly farther along the slide surface for a given position in the swing frame. Preferably, the plates 39 and 41 and/or the plates 19 and 21 are made of a material having a low coefficiency of friction and which is resistent to wear.

Referring to FIG. 4, there is shown a modified guide, generally indicated by the reference numeral 48, which comprises a plate 49 which is fixed to the main frame 12. Upper and lower retaining flanges 50 and 52, respectively, are removably attached to the plate 49 by means of bolts 54. The flanges 50 and 52 extend along the length of the plate 49. A replaceable plate 56 having a slide surface 61 is clamped betweeen the flanges 50 and 52. Each slide member is also modified. The modified slide member is generally indicated by the reference numeral 58 and includes upper and lower brackets 60 and 62, respectively, a plate 59 which extends above and below the upper and lower brackets 60 and 62, respectively. The retaining flange 50 extends below the top of the plate 59 and the retaining flange 52 extends above the lower edge of the plate 59. The flanges 50 and 52 prevent the slide member 58 from pulling away from guide 48 due to unusual jarring or bumping of the swing mechanism and associated parts during operation of the swing frame. The slide plate 56 is made of a material which has a low coefficiency of friction and is resistant to wear.

Referring to FIG. 5, a second modified guide, generally indicated by the reference numeral 64, is shown in conjunction with a second modified slide member, generally indicated by the reference numeral 66. The guide 64 is similar to the guide 48 in that it includes upper and lower retaining flanges 50′ and 52′, respectively, and a plate 49′. The retaining flanges 50′ and 52′ are removably attached to the plate 49′ by means of bolts 54′. The slide member 66 is similar to the slide member 58 in that it includes a plate 59′ and upper and lower horizontal plates 60′; and 62′, respectively. The guide 64 differs from the guide 48 in that it does not include a replacable wear plate. The slide member 66 differs from the slide member 58 in that it includes a wear plate 68 which is attached to the forwardly facing surface of the plate 59′. The plate 68 is, preferably, removably attached to the plate 59′ or it can be permanently attached to the plate 59′ by means of epoxy or the like. The plate 68 is, preferably, made of a material which has a low coefficiency of friction and is resistant to wear. The plate 491 defines a rearwardly facing slide surface 61′ which is engaged by the plate 68.

Figure 10:
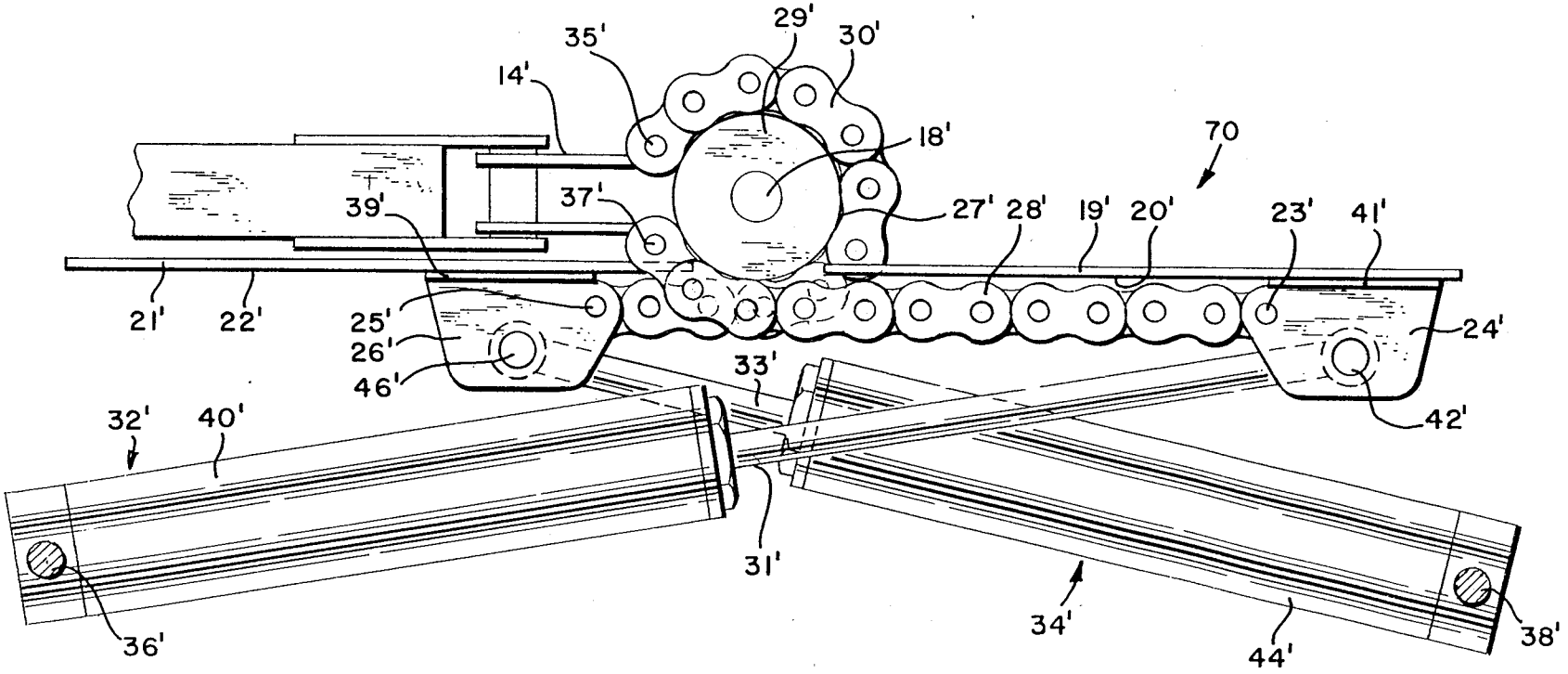
FIG. 10 is a view similar to FIG. 9 showing a first modified swing mechanism.

Referring to FIG. 10, there is shown a first modified swing mechanism, generally indicated by the reference numeral 70, which includes the same elements as the swing mechanism 10 of the preferred embodiment. The elements of the swing mechanism 70 are identified by the same reference numerals as comparable elements of the swing mechanism 10, except that each element of the swing mechanism 70 includes a prime. The swing mechanism 70 functions essentially in the same manner as the swing mechanism 10 and differs primarily in the location and orientation of the guides and hydraulic actuators. The first and second guides which are represented by the plates 19′ and 21′, respectively. The pivot pins 36′ and 38′ for the hydraulic actuators 32′ and 34′, respectively are further rearward from the pivot pin 18′ as compared to the position of the pivot pins 36 and 38 with respect to the pivot pin 18 of the swing mechanism 10. The central longitudinal axes of the hydraulic actuators 32′ and 34′ are always at a convergent angle to the plates 19′ and 21′ when viewed from the top.

Figure 11:
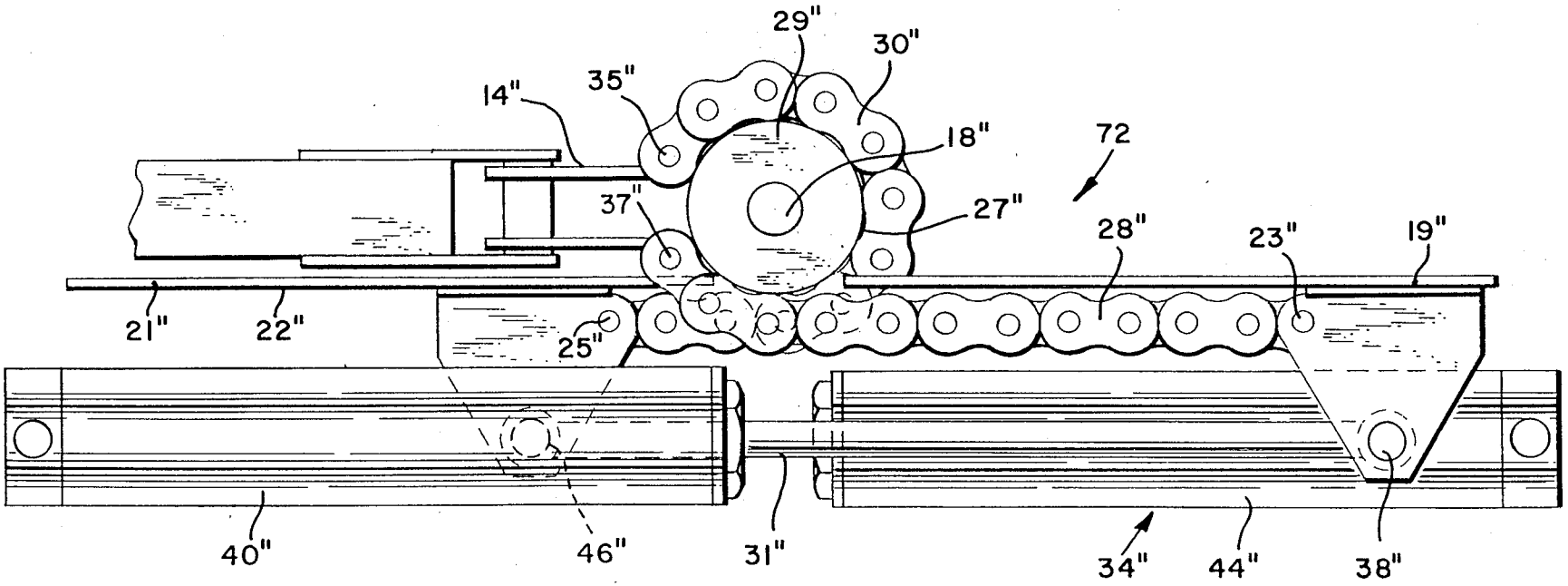
FIG. 11 is a view similar to FIG. 9 showing a second modified swing mechanism.

Referring to FIG. 11 there is shown a second modified swing mechanism, generally indicated by the reference numeral 72. The swing mechanism 72 is similar to the swing mechanisms 10 and 70 in structure and operation. The elements of the second modified swing mechanism 72 are identified with the same reference numerals as comparable elements of the swing mechanism 10, except that the elements of the swing mechanism 72 include a double prime. The first and second guides which are represented by the plates 19″ and 21″ are identical to the first and second guides of the first modified swing mechanism 70. The hydraulic actuators 32″ and 34″ are parallel with their respective guides and remain parallel with the guides throughout the operation of the swing mechanism.

It is obvious that minor changes may be made in the form and construction of the invention without departing from the material thereof. It is not, however, desired to confine the invention to the exact form shown herein and described, but it is desired to all such as properly come within the scope claimed.

The invention having thus been described, what is claimed as new and desired to secure by Letters Patent is:

1. A swing mechanism for an earth moving apparatus comprising:

a main frame having a front and a rear, a pivot means at said front having a vertical axis, a swing frame for swinging movement about said vertical axis, the improvement comprising:

(a) a first guide which is fixed to said main frame and which extends horizontally and laterally of said vertical axis toward one side of said main frame and having a first longitudinal slide surface, (b) a second guide which is fixed to said main frame and which extends horizontally and laterally of said vertical axis towards the opposite side of said main frame, and having a second longitudinal slide surface, (c) a first slide member which is in sliding engagement with said first slide surface, (d) a second slide member which is in sliding engagement with said second slide surface, (e) a first elongated flexible drive connector, one end of which is connected to said first slide member and the other end of which is connected to said swing frame so that movement of said first slide member away from said vertical axis toward said one side of said main frame causes said swing frame to swing toward said opposite side of said main frame, (f) a second elongated flexible drive connector, one end of which is connected to said second slide member and the other end of which is connected to said swing frame so that movement of said second slide member away from said vertical axis toward the opposite side of said main frame causes said swing frame to swing toward said one side of said main frame, (g) a first single acting fluid actuator one end of which is pivotally connected to said main frame for pivotal movement about a vertical axis, the other end of said first single acting fluid actuator being pivotally connected to said first slide member, whereby extending movement of said first single acting fluid actuator causes said first slide member to slide along said first slide surface away from said vertical axis toward said one side of said main frame, and (h) a second single acting fluid actuator, one end of which is pivotally connected to said main frame, for pivotal movement about a vertical axis, the other end of said second single acting fluid actuator being pivotally connected to said second slide member, whereby extending movement of said second single acting fluid actuator causes said second slide member to slide along said second slide surface away from said vertical axis toward the opposite side of said main frame, wherein when viewed from the top, the longitudinal centerline of said first fluid actuator being at a convergent angle to said first longitudinal slide surface and the longitudinal centerline of said second single acting actuator being at a convergent angle to said second longitudinal slide surface.

2. A swing mechanism as recited in claim 1, wherein each of said first and second slide surfaces face away from said swing frame.

3. A swing mechanism as recited in claim 1, wherein the centerline of said first fluid actuator and the centerline of said first elongated drive connector are in a common first horizontal plane, and the centerline of second fluid actuator and the centerline of said second elongated flexible drive connector are in a common second horizontal plane which is vertically spaced from said first horizontal plane.

4. A swing mechanism as recited in claim 1 wherein when viewed from the top, the longitudinal centerline of said first drive connector is at a convergent angle to the longitudinal centerline of said first fluid actuator when said first fluid actuator is extended and the longitudinal centerline of said second drive connector is at a convergent angle to the longitudinal centerline of said second fluid actuator when said second fluid actuator is extended.

5. A swing mechanism as recited in claim 1, wherein with the swing frame at the center of its swing movement, said swing mechanism having a vertical mid plane which passes through the longitudinal centerline of said swing frame and passes through said vertical axis then rearward through said main frame, said first guide being on one side of said mid plane and extending from said one side of said main frame towards said mid plane, said second guide being on said opposite side of said mid plane and extending from said opposite side of said main frame towards said mid plane, and said first slide member being on one side of said mid plane and spaced from said mid plane, said second slide member being on the opposite side of said mid plane and spaced from said mid plane.

6. A swing mechanism as recited in claim 5, wherein one end of said first elongated flexible drive connector is connected to said swing frame and, the other end of said elongated flexible drive connector is connected to said first slide member at a first locality of attachment, wherein one end of said first single acting fluid actuator is pivotally connected to said main frame, and the other end of said first fluid actuator is pivotally connected to said first slide member at a second locality of attachment, the distance of said second locality of attachment to said mid plane being greater than the distance of said first locality of attachment to said mid plane, wherein one end of said second drive connector is connected to said swing frame, and the other end of said second drive connector is connected to said second slide member at a third locality of attachment, and wherein one end of said second single acting fluid actuator is pivotally connected to said main frame, and the other end of which said second fluid actuator is pivotally connected to said second slide member at a fourth locality of attachment, the distance of said fourth locality of attachment to said mid plane being greater than the distance of said third locality of attachment to said mid plane.

7. A swing mechanism as recited in claim 5, wherein said main frame has a vertical cross plane which passes through said vertical axis, intersects said mid plane and is substantially normal to said mid plane, said first guide being on one side of said mid plane and being fixed to said main frame, one end of said first guide being adjacent said mid plane at a first locality, the other end of said first guide being at said one side of said main frame at a second locality, said second guide being on the opposite side of said mid plane and being fixed to said main frame, one end of said second guide being adjacent said mid plane at a third locality, the other end of said second guide being at said opposite side of said main frame at a fourth locality and the distance of each of said second and fourth localities to said cross plane being greater than the distance of each of said first and third localities to said cross plane.

8. A swing mechanism as recited in claim 1, wherein said first and second fluid actuators each have one power chamber of equal fluid displacement, so that for each unit of fluid which is injected into one power chamber to complete one full swing movement in one direction, an equal unit of fluid is injected into the other power chamber to complete one full swing movement in the opposite direction.

9. A swing mechanism as recited in claim 1, comprising a first guide surface which extends about said vertical axis and which is fixed to said swing frame at a first locality of attachment, a second guide surface which extends about said vertical axis and which is fixed to said swing frame at a second locality of attachment, said first drive connector being a first chain which is partially wrapped about said first guide surface and interconnecting said swing frame and said first slide member, said second drive connector being a second chain which is partially wrapped about said second guide surface and interconnecting said swing frame and said second slide member.

10. A swing mechanism as recited in claim 1, wherein when viewed form the top an extension of said first slide surface is at a convergent angle to an extension of said second slide surface.

11. A swing mechanism as recited in claim 1, wherein the longitudinal centerline of said first guide is in a first horizontal plane and wherein the longitudinal centerline of said second guide is in a second horizontal plane which is spaced from said first horizontal plane.

12. A swing mechanism as recited in claim 1, wherein each of said slide surfaces is continuous and faces rearward, wherein each of said slide members is rearward of said slide surfaces, wherein one end of said first elongated drive connector is connected to said swing frame at a first locality of attachment, the other end of said first drive connector being connected to said first slide member at a second locality of attachment and said second locality of attachment being rearward of said first longitudinal slide surface, and wherein one end of said second elongated drive connector is connected to said swing frame at a third locality of attachment, the other end of said second elongated drive connector being connected to said second slide member at a fourth locality of attachment and said fourth locality of attachment being rearward of said second longitudinal slide surface.

13. A swing mechanism for an earth moving apparatus having a main frame, a swing frame for movement about a vertical axis and a boom which is mounted on said swing frame for movement about a horizontal axis, said swing mechanism comprising:

(a) a first guide which is fixed to the main frame and which extends horizontally and laterally of said vertical axis toward one side of said main frame, said first guide having a first elongated vertical guide surface which faces said main frame, (b) a second guide which is fixed to the main frame and which extends horizontally and laterally of said vertical axis toward the opposite side of said main frame, said second guide having a second elongated vertical guide surface which faces said main frame, (c) a first slide member which is in sliding engagement with said first guide surface, (d) a second slide member which is in sliding engagement with said second guide surface, (e) a first elongated flexible drive connector, one end of which is fixed to said first slide member, and the other end of which is operatively connected to said swing frame at a first location so that movement of said first slide member away from said vertical axis toward said one side of said main frame causes said swing frame to swing toward said opposite side of said main frame, (f) a second elongated flexible drive connector, one end of which is fixed to said second slide member and the other end of which is operatively connected to said swing frame at a second location which is vertically spaced from said first location so that movement of said second slide member away from said vertical axis toward said opposite side of said main frame causes said swing frame to swing toward said one side of said main frame, (g) a first single acting fluid actuator for positively moving said first slide member along said first guide surface away from said vertical axis toward said one side of said main frame, one end of said first fluid actuator being pivotally connected to said main frame for swinging about a vertical axis, the opposite end of said first fluid actuator being pivotally connected to said first slide member, said first fluid actuator having a first axis of actuation which is at a convergent angle to said first guide surface from said one end of said first fluid actuator, (h) a second single acting fluid actuator for positively moving said second slide member along said second guide surface away from said vertical axis toward said opposite side of said main frame, one end of said second fluid actuator being pivotally connected to said main frame for swinging about a vertical axis, the opposite end of said second fluid actuator being pivotally connected to said second slide member, said second fluid actuator having a second axis of actuation which is at a convergent angle to said second guide surface from said one end of said second fluid, and (i) control means for selectively actuating said first and second fluid actuators.

* * * * *

UNITED STATES PATENT AND TRADEMARK OFFICE

CERTIFICATE OF CORRECTION

PATENT NO. : 4,904,149
DATED : February 27, 1990
INVENTOR(S) : John S. Pilch

It is certified that error appears in the above-identified patent and that said Letters Patent is hereby corrected as shown below:

Column 6, line 6, change "491" to --491--.

Column 10, line 47, after "fluid", insert ---actuator---.

Signed and Sealed this

Tenth Day of March, 1992

*Attest:*

HARRY F. MANBECK, JR.

*Attesting Officer*

*Commissioner of Patents and Trademarks*